US007278765B2

(12) United States Patent
Cooper et al.

(10) Patent No.: US 7,278,765 B2
(45) Date of Patent: Oct. 9, 2007

(54) WINDOW CANDLE HOLDER

(76) Inventors: James Cooper, P.O. Box 322, Coopersburg, PA (US) 18036; R. Matthew Minielly, 4362 Apple Blossom Dr., Center Valley, PA (US) 18034; Dale Hunter, 16 Eisenhower Cir., Whitehall, PA (US) 18052

( * ) Notice: Subject to any disclaimer, the term of this patent is extended or adjusted under 35 U.S.C. 154(b) by 16 days.

(21) Appl. No.: 11/374,230

(22) Filed: Mar. 13, 2006

(65) Prior Publication Data

US 2007/0211481 A1 Sep. 13, 2007

(51) Int. Cl.
*F21V 21/00* (2006.01)
*A47F 5/00* (2006.01)

(52) U.S. Cl. ..... 362/392; 362/396; 362/810; 248/208; 248/316.7

(58) Field of Classification Search ..... 362/392–393, 362/396, 810; 248/208, 316.7, 316.8
See application file for complete search history.

(56) References Cited

U.S. PATENT DOCUMENTS 2,499,731 A * 3/1950 Derington ..... 40/541
4,392,191 A * 7/1983 White, Sr. ..... 362/392
4,468,721 A * 8/1984 Vandrilla ..... 362/392
4,839,784 A * 6/1989 Lin ..... 362/393
5,199,781 A * 4/1993 Sweeny ..... 362/145
5,249,108 A * 9/1993 Gary ..... 362/388
5,407,164 A * 4/1995 Quinn ..... 248/316.7

* cited by examiner

*Primary Examiner*—Ali Alavi
(74) *Attorney, Agent, or Firm*—Fox Rothschild, LLP; John P. Blasko

(57) ABSTRACT

A holding device for supporting electric or battery-operated window candles in an upright vertical position for viewing through a window. The holding device is comprised of a horizontally extending U-shaped support base, and a vertically extending clip for attaching to a window sash which connects the support base and candle to the window. The support base accommodates a design that holds the candle base in a stationary position while the opposite end abuts the clip and window sash. The clip is attached to the window sash where said sash meets the window sill and extends upwardly. The support base and candle are connected to the window by attaching the back wall of the base to the clip that abuts the window sash. The profile and design does not impede access to normal window functions leaving space between the candle and window handle for grasping.

18 Claims, 3 Drawing Sheets

WINDOW CANDLE HOLDER

FIELD OF THE INVENTION

The present invention relates to window candles, and more particularly to a device for supporting window candles in their upright vertical position on a window sill for visual access.

BACKGROUND OF THE INVENTION

Window candles are used for their aesthetic appeal at various times of the year; however, they are most commonly used around the winter holidays for decoration. The common method of use for the candles is to place them on window sills for viewing from outside the home. Due in part to the awkward cords for electric window candles, a common problem with displaying candles in windows is that it is difficult to adequately support them in a consistent upright manner on even the most common/standard window sill. An object of this invention is to provide support for candles on various types and sizes of window sills. Prior attempts to secure candles to window sills include the use of adhesive tape, thumb tacks, and even stapling said electric cord to the window sill—all ineffective attempts to solving the problem as these methods typically cause damage to the window sill, as well as providing undue stress during the already hectic holiday season.

There are several specimens of prior known art with respect to window candle holders, however, none combine all the features of the said invention for as many types of window sills or candles. For example, U.S. Pat. No. 2,499,731 to Derington discloses a bent wire which fits around the edge of a window sill and extends vertically therefrom. The extending end is used for holding the electric candle. The support is applicable to a particular type of candle which slides on the wire end and can be used with only certain types of window sills.

U.S. Pat. No. 4,392,191 to White discloses a support and candle assembly. The support comprises an L-shaped member having a loop on one end for holding the candle in place, and a wedge type insert on the other end for inserting between the sill and the window sash for securing the support. The insert must be proper in size to fit between the window sill and window sash.

U.S. Pat. No. 4,468,721 to Vandrilla discloses a candle assembly incorporating a leash type device for supporting the candle. The leash device is constructed from a flexible material where one end slips under the window sash and the other around the candle.

U.S. Pat. No. 4,839,784 to Lin discloses a pivoting candle assembly incorporating a suction cup for supporting the candle. The candle can pivot at a single point with the base which allows the candle to remain vertical regardless of the orientation of the surface to which the base is stuck via the suction cup.

Finally, U.S. Pat. Nos. 5,199,781 and 5,407,164 to Sweeny and Quinn, respectively, both incorporate mountings to the window sill that support the base of the candle using force fitting hooks and flexible tabs.

A further need has arisen for a clip that adheres to the window sill or window sash for supporting electric or battery-operated window candles in their upright vertical position that is easy to use and which does not suffer from the heretofore mentioned disadvantages and limitations.

SUMMARY OF THE INVENTION

The invention described in this application is a device for supporting a window candle on a window sill for visual access from the outside. The device provides a more stable and universal method of maintaining window candles in a consistent fashion within the window view.

In accordance with the invention, the device comprises a window sash; a horizontally extending U-shaped base with aforementioned retaining cavity in which candle base is positioned; and a vertical extending clip for attachment to a window sash. Said base then interlocks with the clip to secure said base in a stationary and uniform position.

The base extends horizontally when installed and is comprised of one end, the contact end, which abuts to the clip and window sash, and another end, the candle end, which supports the window candle. The clip is installed to the window sash and while installed extends upward and outward from the window sash. The clip is comprised of two ends each having grasping mechanisms that extend therefrom which can be attached to the fastening tabs or indentations on the sidewalls of the base.

The respective and simultaneous contact of the base with the window sill and the clip with the window sash causes the base to rest horizontally. It is a further object of the invention to provide a holder which is easily attached to window sills and/or window sashes of various thicknesses and which does not impede the normal operation of the window.

BRIEF DESCRIPTION OF THE DRAWINGS

For the purposes of providing a fuller understanding of the nature of the invention, there is shown in the accompanying drawings herein one form which is presently preferred; it being understood that the invention is not intended to be limited to the precise arrangements and instrumentalities shown.

DETAILED DESCRIPTION OF THE INVENTION

Figure 1:
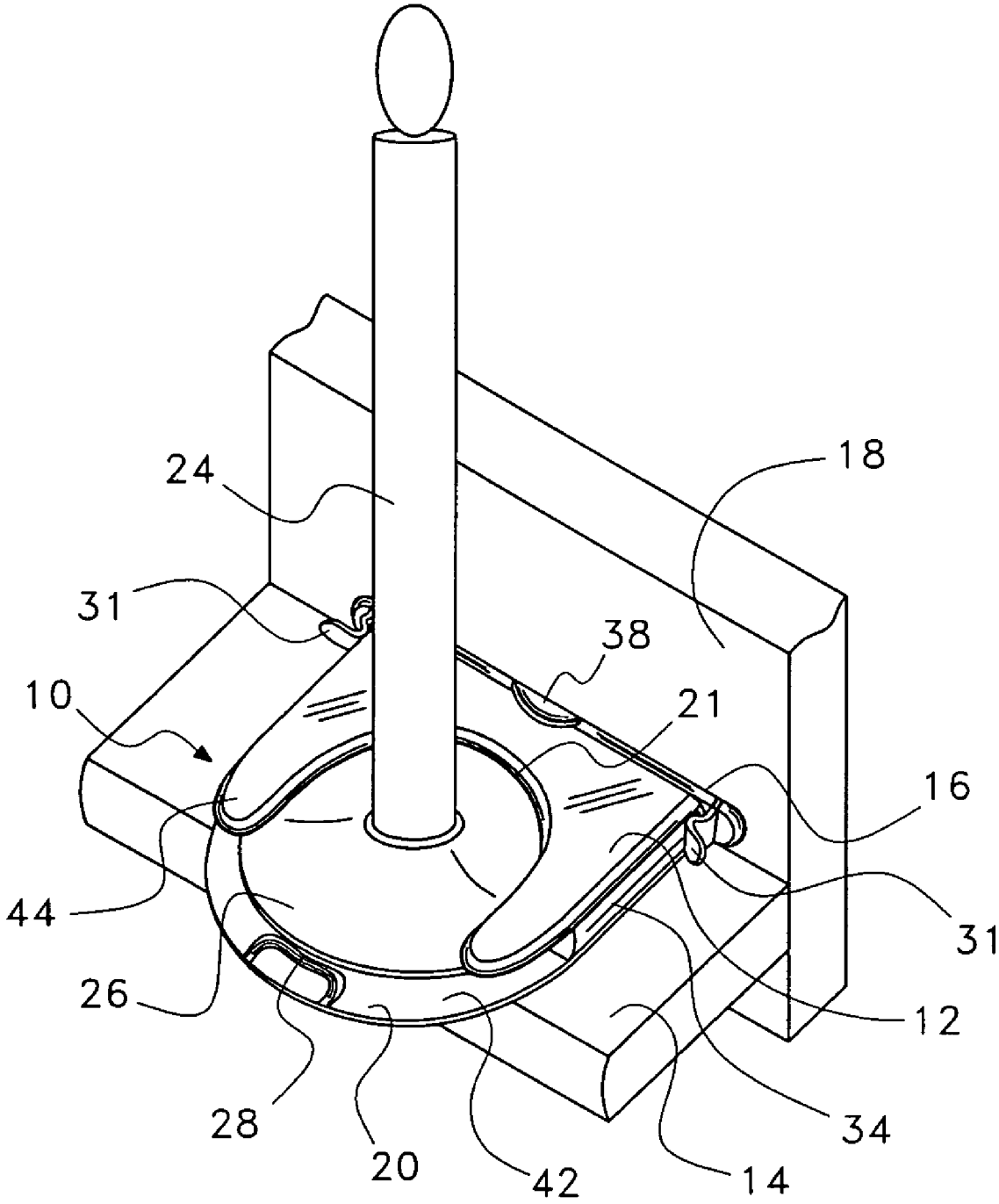
FIG. 1 is a perspective view of the window candle holder assembly while installed.

Referring now to the drawings in detail wherein like reference numerals have been used throughout the various figures to designate like elements, there is shown in FIG. 1 a perspective view of the window candle holder constructed in accordance with the general principles of the invention and designated generally as 10. The window candle holder 10 is comprised of a support base 12 that rests on or is attached to window sill 14, and a mounting clip 16. The mounting clip 16 being attached to a window sash 18 interacts with the support base 12 securing the holder 10 to both the window sill 14 and window sash 18.

In the preferred embodiment, the window candle holder 10 is preferably constructed from plastic, wood or metal. While installed, the base 12 extends in a horizontal plane. The support base 12 is comprised of a candle end 20 and a contact end 22. The candle end 20 provides the means for attaching a window candle 24. The candle end 20 is preferably substantially circular in shape and of a diameter large enough to accommodate a window candle base 26. The candle end 20 includes the means for holding the candle base 26 and candle 24 to the support base 12 by using a positioning tab 28.

The support base 12 has a lower supporting portion 42, an upper supporting portion 44, and sidewalls 34 and 36 substantially perpendicular to both the lower and upper supporting portions 42 and 44 to form receptacle 46 for receiving and retaining at least a portion of candle base 26. The candle end edge 21 of upper supporting portion 44 is preferably arcuate, more preferably semi-circular, and adapted to engage a portion of the circular candle base 26 of window candle 24. The support base 12 then attaches to the mounting clip 16 by using grasping mechanism 32.

Figure 2:
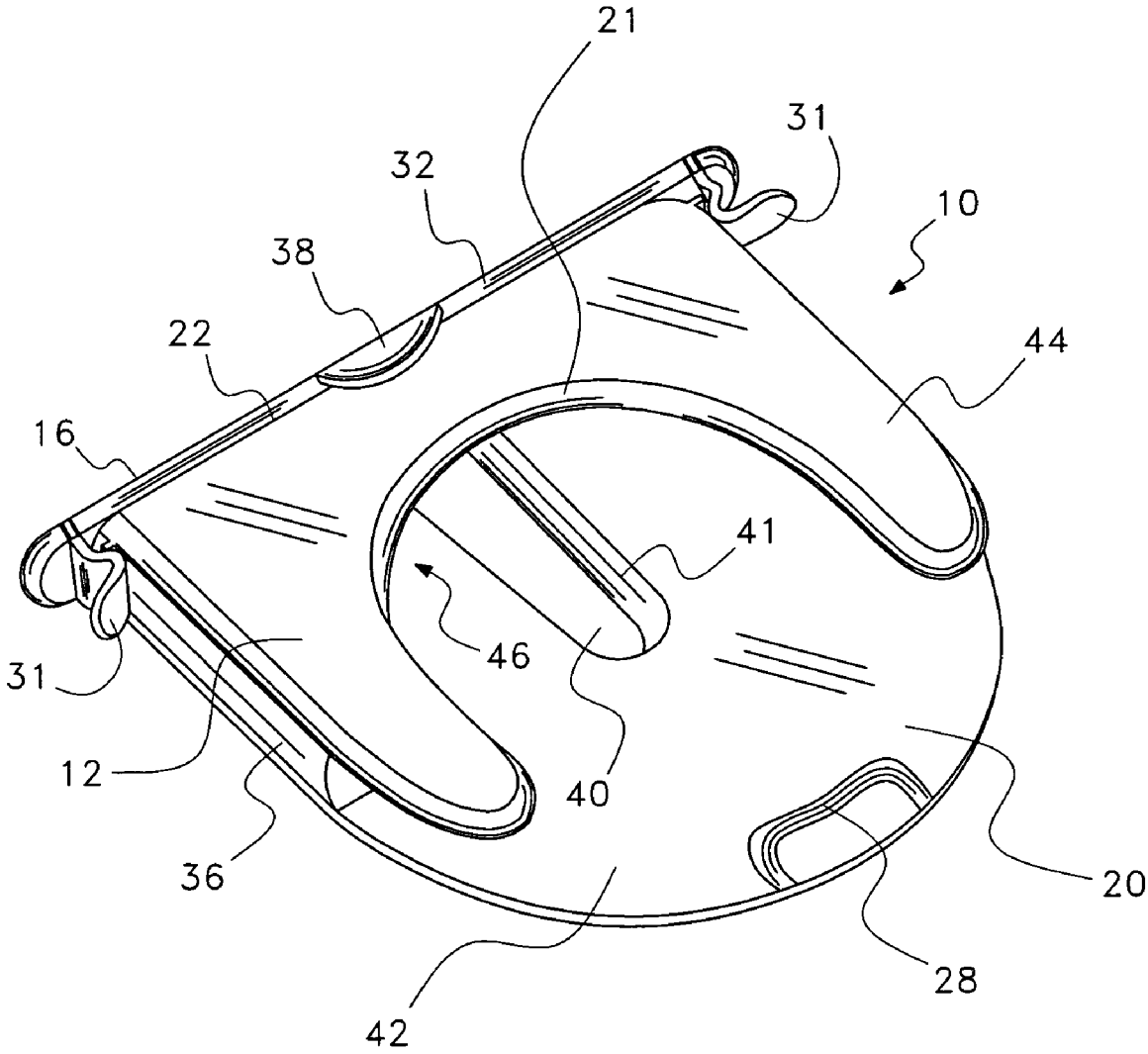
FIG. 2 is a perspective view of the base of the window candle holder assembly attached to mounting clip.

Referring to FIG. 2 and toward the contact end 22 of the support base 12, a mounting clip 16 acting as a stabilizer extends perpendicularly from the support base 12 and attaches to the window sash 18. The mounting clip 16 interacts with the support base 12 for supporting the window candle 24. Flexible prongs 31 engage fastening tabs 30 of sidewalls 34 and 36 when contact end 22 is positioned against mounting clip 16.

Figure 3:
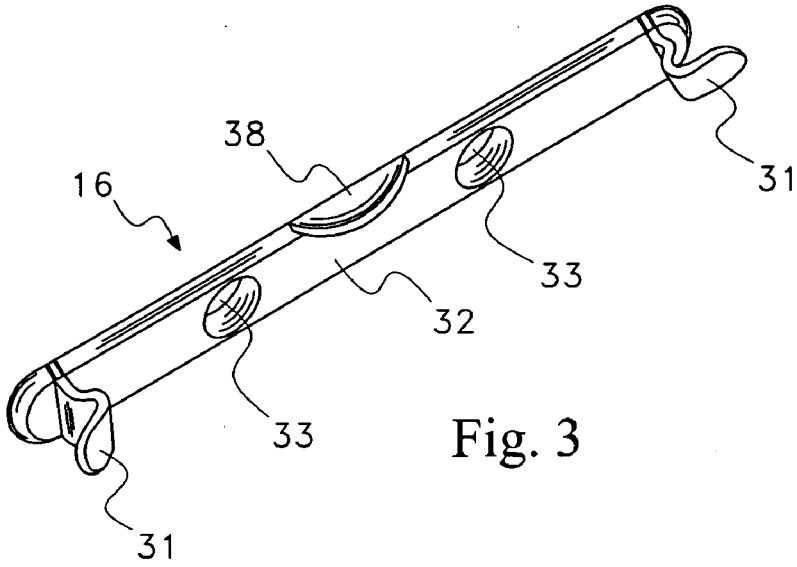
FIG. 3 is a perspective view of the clip of FIG. 2 showing the mounting options to the window sash and protruding grasping mechanism for attaching and supporting base.
Figure 4:
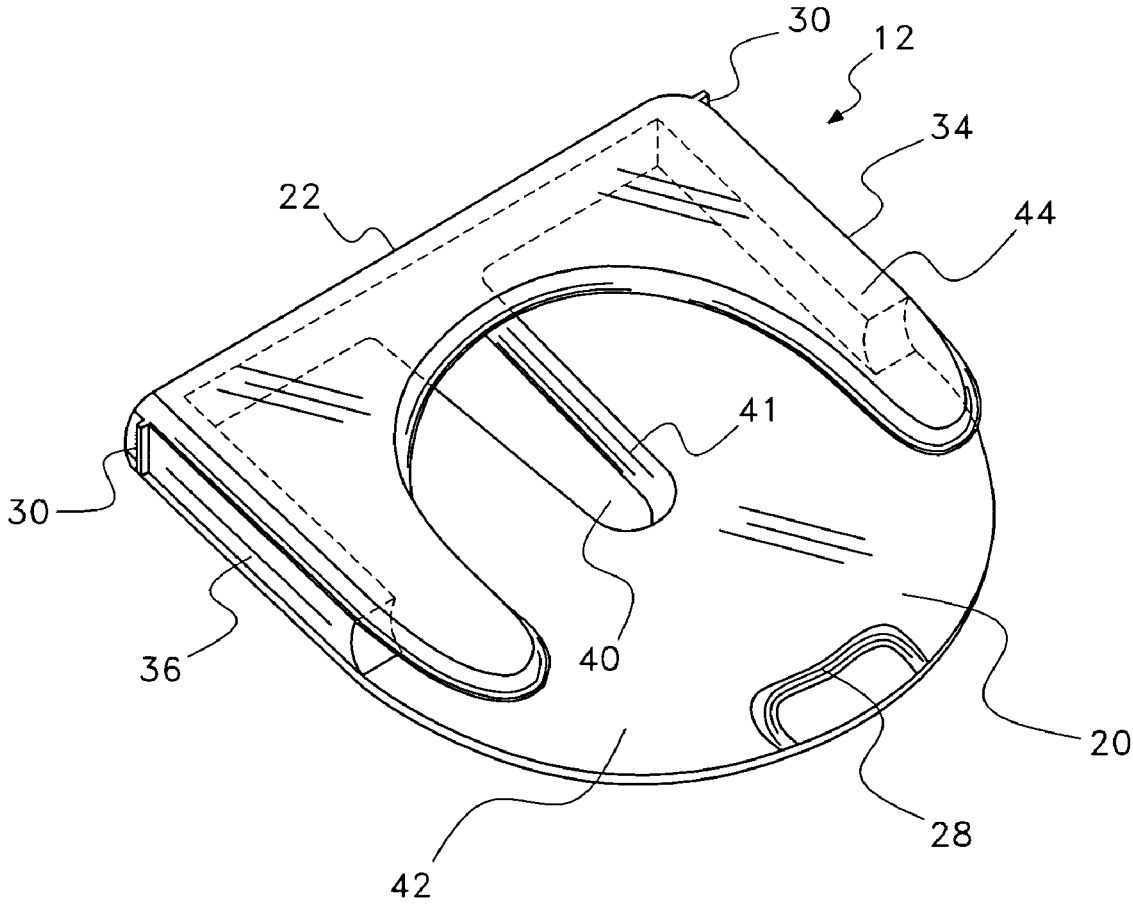
FIG. 4 is a perspective view of the base of FIG. 2 showing the fastening tabs used to attach to mounting clip, the candle support clip and a permanent mounting option available for year-round window candle users.

Referring now to FIGS. 3 and 4 and to the mounting clip 16, the clip can be attached to the window sash either by mounting screws through mounting holes 33 or with pressure sensitive adhesive. The mounting clip stabilizes the support base 12 and candle 24 to the window. The mounting clip 16 is comprised of the grasping mechanism 32 to secure the support base 12 in place. Grasping mechanism 32 comprises inward facing flexible prongs 31 which engage fastening tabs 30 when contact 22 of base 12 is positioned between prongs 31.

The window candle holder assembly is used by first attaching the mounting clip 16 to the window sash 18 by using mounting screws, pressure sensitive adhesive pads, or other suitable securing devices. The support base 12 may then be attached to the mounting clip 16 by inserting contact end 22 of base 12 between prongs 31 of grasping mechanism 32. Mounting clip 16 preferably also comprises guide tab 38 which prevents vertical movement of base 12 when base 12 is engaged by prongs 31 of grasping mechanism 32. The candle 24 may then be placed on the support base 12 at the candle end 20 and secured thereto using the positioning tab 28.

Alternatively, support base 12 may be secured to window sill 14 by a securing device such as a screw (not shown) positioned in slot 40. Slot 40 preferably has beveled walls 41 which may engage the sides of the head of a typical wood screw. Other securing means may be used such as nails, adhesives, pressure sensitive adhesive pads or the like. While the illustrated preferred embodiment has no sidewall along contact end 22, an alternative embodiment may comprise such sidewall which may be useful a mounting clip is not utilized.

The invention may be embodied in other specific forms without departing from the spirit or essential attributes thereof and accordingly reference should be made to the appended claims rather than to the foregoing specification as indicating the scope of the invention.

What is claimed is:

1. A device for holding and supporting electric or battery-operated window candles on a window sill and/or attaching to a window sash and the like, said device comprising:

(a) a base for supporting a window candle having a lower supporting portion having a candle end and a contact end, an upper supporting portion, said upper supporting portion and said lower portion being substantially perpendicular to sidewalls positioned between said upper and lower portions at the ends of said contact end, a receptacle formed by said upper and lower portions and said sidewalls to support said candle at said candle base; and (b) a stabilizing clip, having first and second ends and an intermediate portion, said first and second ends having outwardly projecting prongs, said intermediate portion attachable to said window sash with said intermediate portion and prongs sized and shaped to receive and hold said base between said prongs to support said candle.

2. The device as claimed in claim 1 wherein said base extends horizontally and said clip extends vertically substantially perpendicular to said base when installed on a window sill and a window sash.

3. The device as claimed in claim 2 wherein the lower supporting portion of said base is substantially U-shaped, said candle end is substantially circular in shape and said contact end is substantially rectangular and abuts to said clip and said sash.

4. The device as claimed in claim 3 wherein sidewalls of have protrusions facing outwardly to provide a fastening tab engageable by said prongs at each of said first and second ends of said clip.

5. The device as claimed in claim 3 wherein sidewalls of have indentations engageable by said prongs at each of said first and second ends of said clip.

6. The device as claimed in claim 1 wherein said stabilizing clip is located towards said contact end of said base and abuts to window sash, said prongs at said ends of said clip interlocking with said fastening tabs on said sidewalls.

7. The device as claimed in claim 1 wherein said base comprises a positioning tab on said candle end of said lower supporting member and positioned to retain said candle base within said receptacle.

8. The device as claimed in claim 1 wherein said base comprises a slot in said lower supporting member extending from said contact end towards said candle end.

9. The device as claimed in claim 1 wherein an edge of said upper supporting portion facing said candle end of said base is arcuate in shape and adapted to engage said candle base.

10. The device as claimed in claim 1 wherein said clip comprises a guide tab positioned on said intermediate portion to engage said upper supporting portion when said base abuts said clip.

11. A device for holding and supporting electric or battery-operated window candles on a window sill and/or attaching to a window sash and the like, said device comprising:

a base for supporting a window candle having a lower supporting portion having a candle end and a contact end, an upper supporting portion, said upper supporting portion and said lower portion being substantially perpendicular to sidewalls positioned between said upper and lower portions at the ends of said contact end, a receptacle formed by said upper and lower portions and said sidewalls to support said candle at said candle base, and a securing device for securing said base to said window sill.

12. The device as claimed in claim 11 wherein an edge of said upper supporting portion facing said candle end of said base is arcuate and adapted to engage said candle base.

13. The device as claimed in claim 11 wherein said securing device is a screw disposed in a slot in said lower supporting member extending from said contact end towards said candle end.

14. The device as claimed in claim 11 wherein said securing device is a stabilizing clip, having first and second ends and an intermediate portion, said first and second ends having outwardly projecting prongs, said intermediate portion attachable to said window sash with said intermediate portion and prongs sized and shaped to receive and hold said base between said prongs to support said candle.

15. A window candle assembly comprising:

a window candle having a window candle base; and a device for securing said window candle to a window sill and/or a window sash, said device comprising a base for supporting said window candle having a lower supporting portion having a candle end and a contact end, an upper supporting portion, said upper supporting portion and said lower portion being substantially perpendicular to sidewalls positioned between said upper and lower portions at the ends of said contact end, a receptacle formed by said upper and lower portions and said sidewalls to support said candle at said candle base, and a securing device for securing said base to said window sill.

16. The assembly as claimed in claim 15 wherein said securing device is a stabilizing clip, having first and second ends and an intermediate portion, said first and second ends having outwardly projecting prongs, said intermediate portion attachable to said window sash with said intermediate portion and prongs sized and shaped to receive and hold said base between said prongs to support said candle.

17. The assembly as claimed in claim 15 wherein an edge of said upper supporting portion facing said candle end of said base is arcuate in shape and adapted to engage said candle base.

18. The device as claimed in claim 17 wherein said base comprises a positioning tab on said candle end of said lower supporting member and positioned to retain said candle base within said receptacle.

* * * * *